US006045000A

United States Patent [19]

Rauworth et al.

[11] Patent Number: 6,045,000

[45] Date of Patent: Apr. 4, 2000

[54] BLOW MOLDED DRUM

[76] Inventors: Barry Lee Rauworth, 8115 Trillium Cir., Victoria, Minn. 55386; John M. Hennen, 6571 Mistral La., Eden Prairie, Minn. 55346

[21] Appl. No.: 08/982,671

[22] Filed: Dec. 2, 1997

[51] Int. Cl.[7] ..... B65D 25/00

[52] U.S. Cl. ..... 220/601; 220/4.05; 220/203.01

[58] Field of Search ..... 220/601, 608, 220/634, 4.05, 203.01

[56] References Cited

U.S. PATENT DOCUMENTS

| | | | |
|---|---|---|---|
| 3,167,931 | 2/1965 | Bryson | 220/203.01 X |
| 3,294,271 | 12/1966 | Armbruster . | |
| 3,419,173 | 12/1968 | Verlinden | 220/4.05 |
| 3,827,595 | 8/1974 | Reynolds . | |
| 3,912,110 | 10/1975 | Hammes . | |
| 4,114,779 | 9/1978 | Stoll, III | 220/601 X |
| 4,117,062 | 9/1978 | Uhlig . | |
| 4,170,623 | 10/1979 | Dubois et al. . | |
| 4,201,306 | 5/1980 | Dubois et al. | 220/4.05 |
| 4,228,122 | 10/1980 | Hammes . | |
| 4,228,911 | 10/1980 | Hammes . | |
| 4,257,527 | 3/1981 | Snyder et al. . | |
| 4,378,328 | 3/1983 | Przytulla et al. . | |
| 4,539,172 | 9/1985 | Winchell et al. . | |
| 4,589,563 | 5/1986 | Born . | |
| 4,767,021 | 8/1988 | Pies . | |
| 4,925,049 | 5/1990 | Przytulla . | |
| 4,941,584 | 7/1990 | Bowers et al. | 220/601 |
| 4,946,368 | 8/1990 | Masumoto . | |
| 4,962,863 | 10/1990 | Wendling et al. . | |
| 5,014,873 | 5/1991 | Clemens et al. . | |
| 5,033,639 | 7/1991 | Przytulla . | |
| 5,044,510 | 9/1991 | Schütz . | |

(List continued on next page.)

FOREIGN PATENT DOCUMENTS 2 016 402B 8/1978 United Kingdom .

OTHER PUBLICATIONS

A Packaging Partner With A Vivion, VanLeer Containers, Inc. ISO 9002 Certification.
55 Gallon Composite Drums, VanLeer Containers, Inc.
Valerex 55 Plastic Drums, VanLeer Containers, Inc. extruded body.
Supershipper Bergen Barrel & Drum Co. Polyethylene Drums & Tanks.
Schütz Ecodrum EB, Sonoco Products Co., HMW HDPE resin.
Power Drum, Kodama Plastics, Co., Ltd., attachment 1.
Greif Bros. Corporation, Plast–I–Barrell.
U.S. Coexcell, Inc.
Computerized Data Search File 340 Utility type document.

*Primary Examiner*—Steven Pollard
*Attorney, Agent, or Firm*—Patterson & Keough, P.A.

[57] ABSTRACT

A plastic blow molded drum has unique top and bottom structure providing protection and strength for the drum and attachments. An integrally formed top structure with a sufficiently deep recess provides protection for drum inserts and associated closures. Additionally, the bottom structure includes a sump and structural member formed by the pinched-off parisan during the blow molding process. The drum has a top wall, a cylindrical side wall, and a bottom wall defining an open interior. The top wall has an access port comprising a fitting integrally formed with the drum. The fitting having an upwardly extending neck with inside threads and a top shoulder. A drum insert is engaged with the fitting and provides an additional second threaded fitting and a second shoulder both extending upwardly above the shoulder of the integral fitting. A closure comprising a plug portion and a threaded nut portion engages the second threaded fitting, closes the port, and extends above the second shoulder. The closure has an uppermost portion, which may be a protective cover or venting valve handle. The protective recess may suitably be formed by the chime and/or further downward recessed portions of the top wall such that the first fitting, the second fitting, and the closure, including the uppermost portion of the closure are all below the top edge of the chime.

18 Claims, 6 Drawing Sheets

U.S. PATENT DOCUMENTS 5,071,028 12/1991 Murphy .
5,217,138 6/1993 Nichols ..... 220/601 X
5,217,142 6/1993 Schütz .
5,273,181 12/1993 Gay .
5,285,923 2/1994 Brandon, Jr. .
5,346,094 9/1994 Strawser .
5,402,909 4/1995 Cramer et al. .
5,413,240 5/1995 Hunter et al. ..... 220/601 X
5,449,087 9/1995 Mikula et al. .
5,543,107 8/1996 Malik et al. .
5,619,798 4/1997 Luburie et al. .

BLOW MOLDED DRUM

BACKGROUND OF THE INVENTION

This invention relates to drums or barrels. More particularly it relates to plastic drums with drum inserts for accessing the fluid in the drum and closures for same.

Steel and plastic drums are utilized in many industries for transporting and storing various liquids which may be utilized as fuels, lubricants, ingredients, process fluids, or the like. Often the liquids transported and stored in such drums are highly caustic and/or hazardous and absolute containment during storage, transport, and handling are essential. For example in the semiconductor industry, caustic chemicals such as hydrofluoric acid are commonplace. Some liquids develop significant internal gas pressures when contained during storage. Such pressures must be periodically vented. Even when drums with such hazardous and caustic liquids are on site and ready for use, great care must be taken in accessing the liquids so as not to expose personnel or the environment to such chemicals.

Plastic drums utilized in the semiconductor processing industry typically have standardized openings on the top of the drums. These openings comprise a pair of ports or bungholes, each having a fitting with a neck extending upward from the top wall of the drum approximately 1 to 1½ inches. The ports each have 2 inch internal buttress threads. Several closures or bungs may be utilized with these standardized ports including standard bung closures which are threadedly inserted into the openings and which engage with the top shoulder of the neck. These standard bung closures extend a fraction of an inch above the neck.

Access to the liquids in the plastic drums is typically accomplished by multiple port bung connectors which attach to drum inserts such as disclosed in U.S. Pat. No. 4,699,298, issued to Grant, et al, and assigned to FSI International Corporation and as disclosed in U.S. Pat. No. 5,108,015, issued to Rauworth, the inventor in the instant application with the same assignee, Fluoroware, Inc. These patents are hereby incorporated by reference. The bung connectors illustrated in these patents have drum inserts with down hole tubes extending to the inside bottom of the drums for withdrawing the liquid in the drum and for providing a means for sensing the level of the liquid in the drum. An additional tube or port in the insert is utilized for supplying air or other gas to replace the liquid as it is withdrawn. The drum insert is threadably engaged to one of the ports at the buttress threads in place of and in the same fashion as a standard bung closure. The drum insert has external threads to engage the multiple port bung connector head which will have lines to the processing equipment or other storage containers.

The drum inserts, as disclosed in Grant and Rauworth patents extend above the shoulder of the neck of the drum port into which they are installed approximately ⅜ to ½ of an inch. Closures for the drum inserts to be used when the multiple port bung connector head is not in place are configured in several different ways. For example the closure of FIG. 5 includes a vent connection port and a valve for venting internal drum pressure. Each configuration of closures add an inch to an inch and ¼.

To aid in handling steel and plastic drums, protruding annular lips, commonly termed "chimes", will typically be an integral part of or an attached part of the drums. The chimes extend upwardly at the top and downwardly at the bottom of the drums. The chimes provide a grasping lip which is gripped by mechanized handling equipment equipped with a "parrot beak".

Drums may be stacked either with pallets or other spacers intermediate vertically adjacent drums or the drums may simply be stacked on top of one another. The chime at the top of the drum also provides protection to the top ports and connectors, particularly when the drums are stacked. The top of the chime needs to extend above the ports and connectors to provide this protection. Known existing drums with integral chimes extend at most, only a fraction of an inch above the shoulder of each neck at the drum ports. Although plastic composite drums are known which utilize a separate chime portion attached to the top of the drum and which are positioned high enough off the top of the drum such that the various known closures do not extend thereabove, the prior art does not disclose such a drum with an integral top structure.

SUMMARY OF THE INVENTION

A plastic blow molded drum has unique top and bottom structure providing protection and strength for the drum and attachments. An integrally formed top structure with a sufficiently deep recess provides protection for drum inserts and associated closures. Additionally, the bottom structure includes a sump and structural member formed by the pinched-off parisan during the blow molding process. The drum has a top wall, a cylindrical side wall, and a bottom wall defining an open interior. The top wall has an access port comprising a fitting integrally formed with the drum. The fitting having an upwardly extending neck with inside threads and a top shoulder. A drum insert is engaged with the fitting and provides an additional second threaded fitting and a second shoulder both extending upwardly above the shoulder of the integral fitting. A closure comprising a plug portion and a threaded nut portion engages the second threaded fitting, closes the port, and extends above the second shoulder. The closure has an uppermost portion, which may be a protective cover or venting valve handle. The protective recess may suitably be formed by the chime and/or further downward recessed portions of the top wall such that the first fitting, the second fitting, and the closure, including the uppermost portion of the closure are all below the top edge of the chime.

The bottom structure has a lower chime, a sump directly below the access port, and channels extending into the sump. A structural member formed of the parisan pinch off material extends in a diametric direction across the mid-portion of the bottom wall.

DETAILED SPECIFICATION

Figure 1:
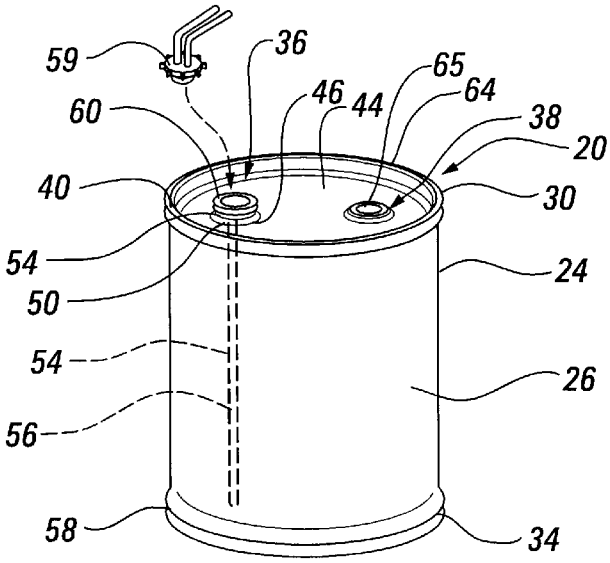
FIG. 1 is perspective view of the combination of a drum, drum insert, and closure.
Figure 2:
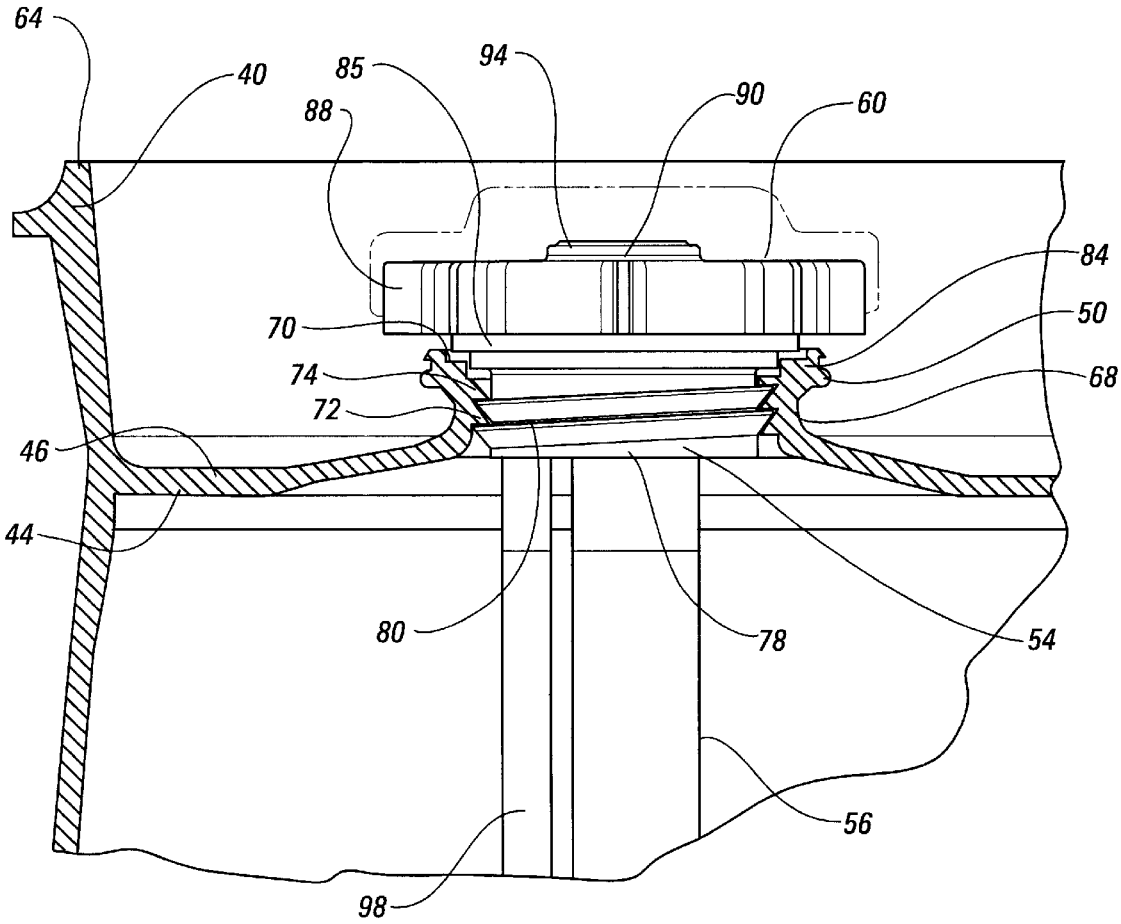
FIG. 2 is a detailed cross-sectional view of the top structure of a drum at a bunghole with a drum insert and closure in place.

Referring to FIGS. 1 and 2, the invention is generally designated with the numeral 20. FIG. 1 shows in perspective a plastic blow molded drum 24 comprised of a cylindrical wall portion 26, a top structure 30 and a bottom structure 34. The top structure is comprised of an upwardly extending chime 40, a top wall 44 including a recessed portion 46, and an upwardly extending first fitting 50. FIG. 2 shows a portion of the drum and added components forming the inventive combination.

Attached and inserted into the first fitting is a drum insert 54 which includes a tube 56 which extends downwardly to the bottom 58. Threadably secured to the drum insert 54 is the closure 60 which plugs the drum insert 54. Shown displaced from the drum, is a multiple port bung connector 59 which also fits on the drum insert 54 in place of the closure when the liquid in the drum is to be withdrawn. Significantly, the closure as well as the drum insert are positioned below the top edge 64 of the chime 40. The top structure has a first bunghole 36 and a second bunghole 38. As shown in FIG. 1, a second bunghole utilizes a standard bung 65 which sealingly and threadably engages with the second bung hole 38. Referring to FIG. 2, a detailed cross-sectional view of the top structure and the first bunghole is shown. The first fitting 50 has a first neck portion 68 and a first shoulder 70. On the inside of the neck portion are two inch buttress threads 72 which have become standard in the industry. The first fitting 50 extends upwardly from the recessed portion 46 of the top wall 44.

Figure 4:
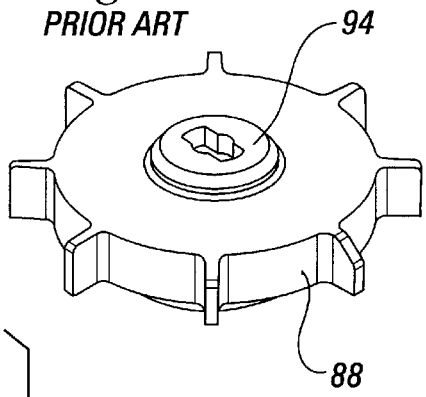
Fig. 4 PRIOR ART
FIG. 4 is a perspective view of a closure known in the art.
Figure 3:
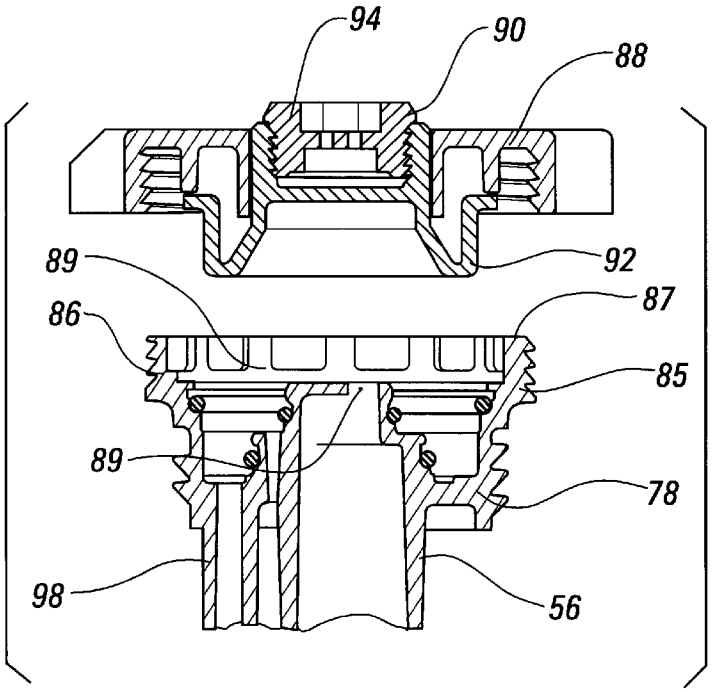
Fig. 3 PRIOR ART
FIG. 3 is an exploded cross-sectional elevational view of a drum insert and closure known in the art.

Referring to FIGS. 2 and 3, engaged with the threaded portion 74 is the drum insert 54. The drum insert has a base portion 78 which includes threads 80 which engage with the buttress threads 72 of the first neck portion 68. The drum insert includes a seating portion 84, which engages and seats on the first shoulder 70, a second fitting 85 with a second threaded neck portion 86, a second shoulder portion 87, and fluid flow openings 89.

Closing the drum insert is the bung or closure 60 which is comprised of a nut portion 88, configured as a handle, and a plug portion 90. The plug portion 90 may be comprised of two components joined together, a sealing member 92 and a retaining member 94. The handle 88 freely rotates with respect to the plug portion 90.

The drum insert also has a downhole tube portion 55 and suction tube 56 for withdrawing the liquid and a level sensing tube 98, both extending from the base portion 78.

Figure 6:
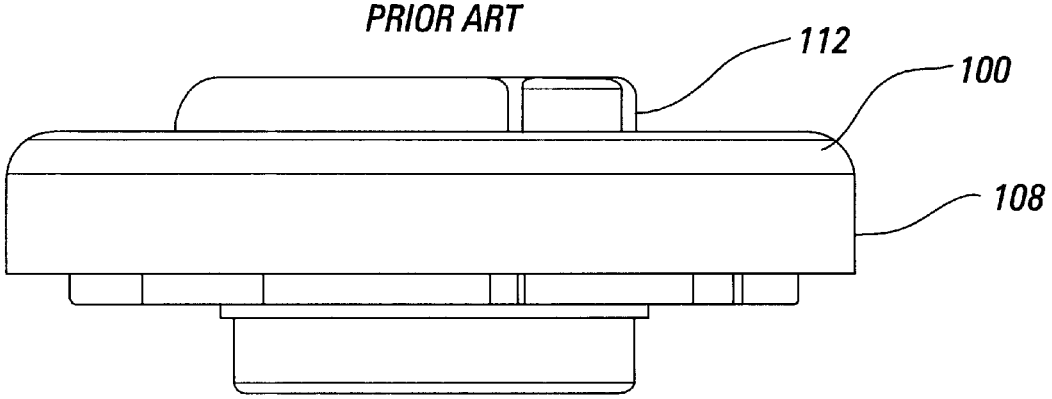
Fig. 6 PRIOR ART
FIG. 6 is an elevational view of the closure of FIG. 5 known in the art.
Figure 5:
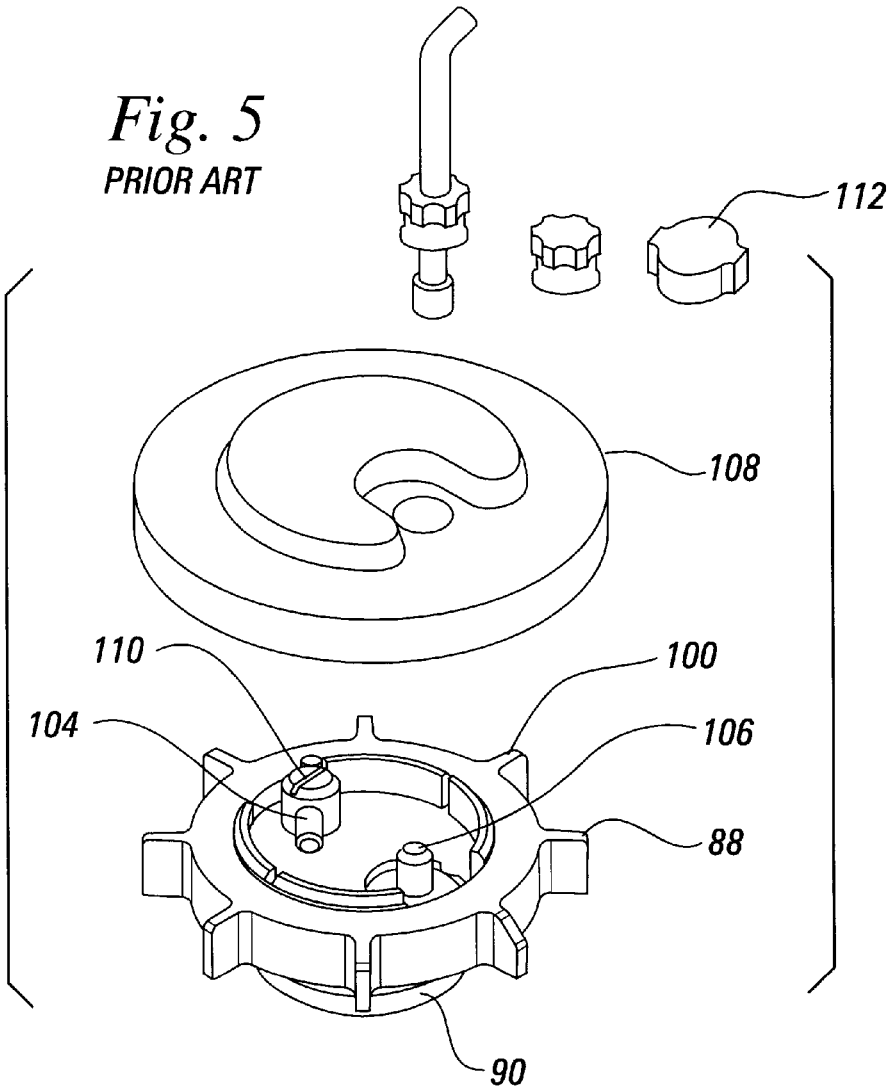
Fig. 5 PRIOR ART
FIG. 5 is a exploded perspective view of a venting bung closure known in the art.

An alternative closure is shown in FIGS. 5 and 6. This venting closure 100 has a nut portion 88, configured as a handle, a plug portion 90, both similar to these components in the closure of FIGS. 2 and 3. Additionally the venting closure 100, has a valve 104, a valve handle 110, and a vent port or outlet 106. A cover 108 engages and fits over the valve handle 110 and may be secured in place by way of a cap 112 which engages on and seals the outlet 106. The closures of FIGS. 3 and 5 are known in the art and are available from Fluoroware, Inc., the assignee of this application.

Referring to FIG. 2, the dashed lines with the numeral 116 indicate the relative positioning of the venting closure with the cover 108 and cap 112 in place. The top structure including the chime 40 and top wall 44 are configured such that even with this relatively "high" closure, the top edge 64 of the chime is still the uppermost part of the combination.

Figure 7:
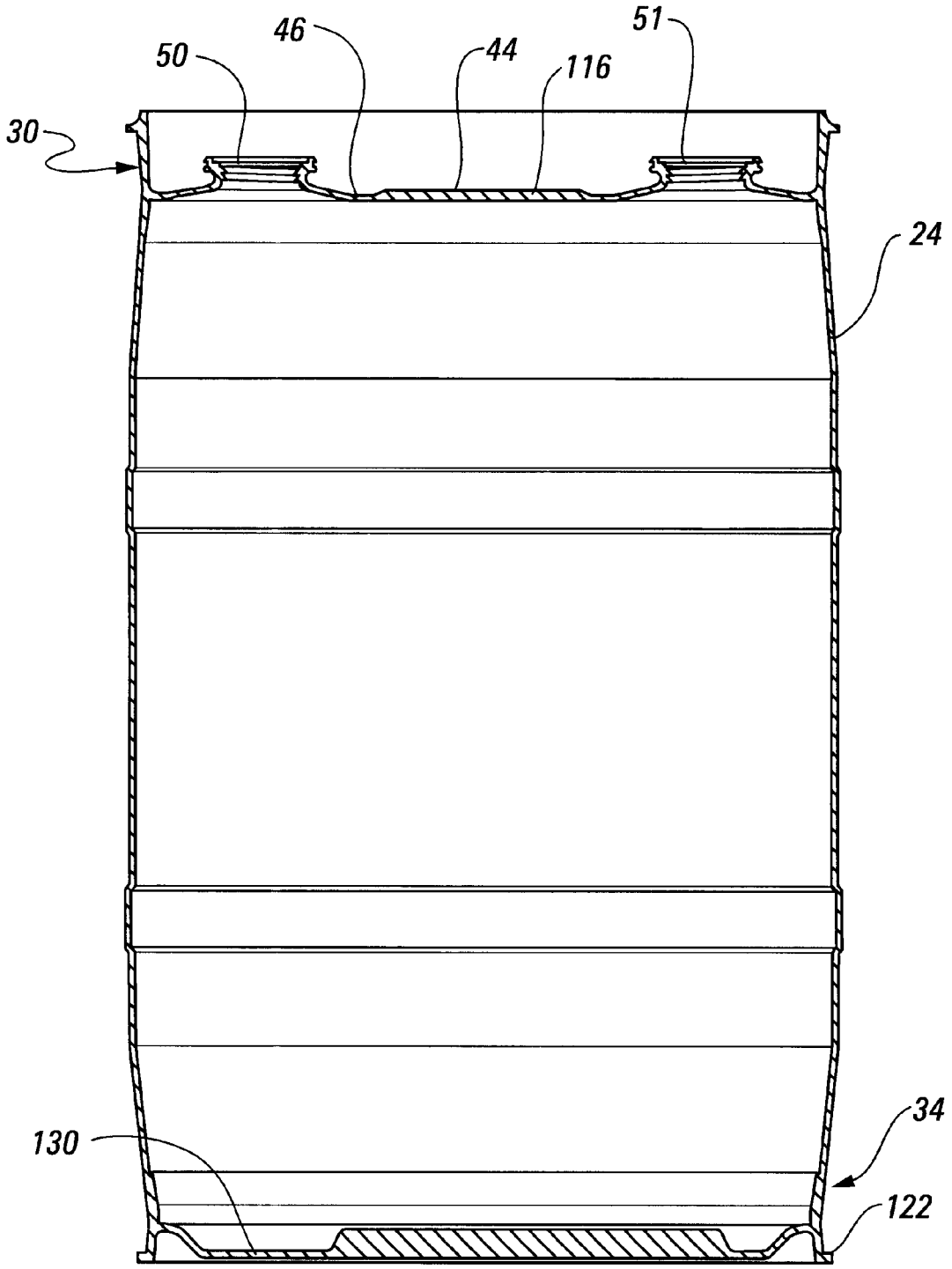
FIG. 7 is a cross-sectional view of a drum according to the invention.

Referring to FIG. 7, a detailed cross-sectional view of the drum without attached drum inserts or closures is shown. In this embodiment the fittings 50, 51 extend upwardly from a slightly recessed portion 46 of the top wall 44. The mid-portion 116 of the top wall is shown as being slightly thickened relative to the recessed portion 46. This allows the fittings to drain adequately when the drum 24 is tipped upside down.

Figure 8:
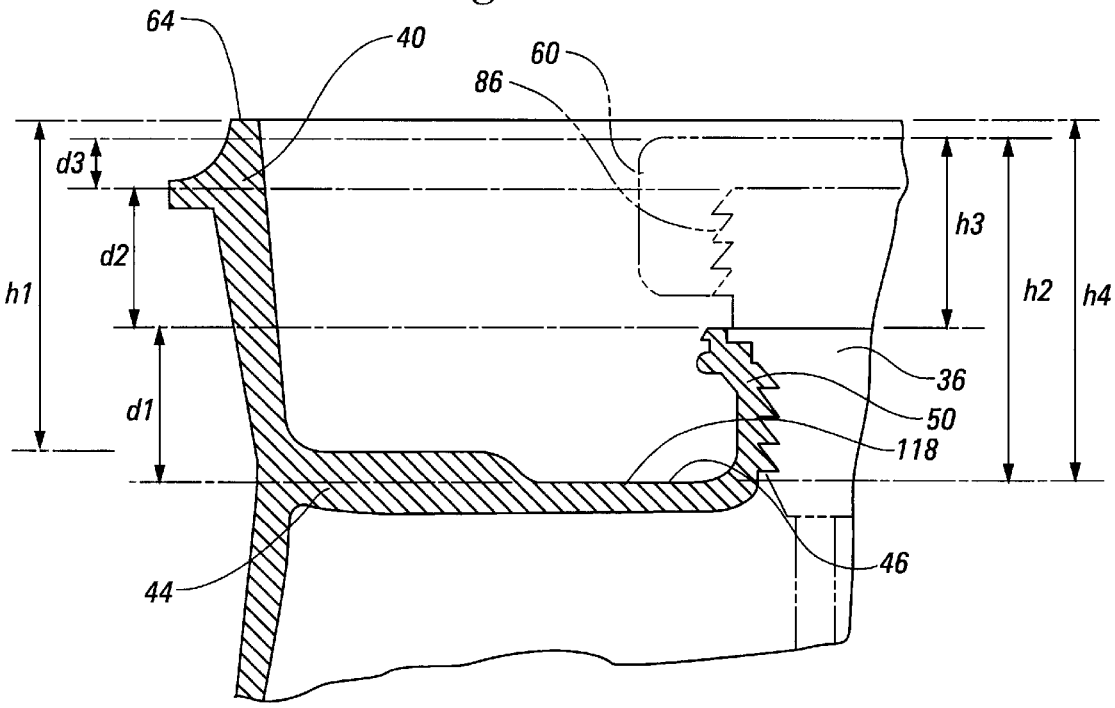
FIG. 8 is a cross-sectional view of the top structure of a drum according to the invention and illustrating relative dimensions.
Figure 9:
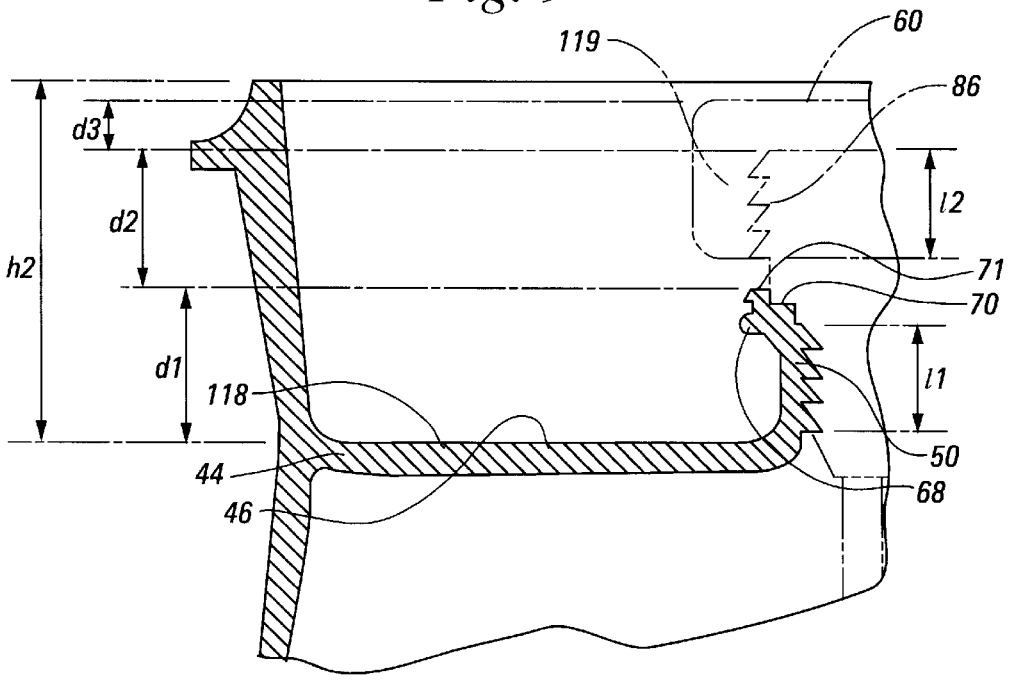
FIG. 9 is a cross-sectional view of the top structure of a drum according to the invention and illustrating relative dimensions.

Referring to FIGS. 8 and 9, the relative size and positioning of pertinent features of the top structure are illustrated. The recess portion 46 of the top wall 44 can be localized at the bunghole 36, FIG. 8, or can extend to substantially all of, including all of the top wall, FIG. 9. The bunghole 36 will typically be the standard two inch opening. The first fitting will extend a distance d1 of approximately 1 to 1¼ inches above the top surface 118 of the recessed portion 46 of the top wall 44. The drum insert 54 will typically extend a distance d2 of 1 to 1½ inches above the shoulder 70 or the uppermost surface 71 of the first fitting 50. The closures 60 will typically extend a distance d3 of ⅜ to 1 inch. The required height h1 of the chime above the top surface 118 can vary depending on the configuration of the top wall 44. If the recess portion 46 is localized at the bunghole as shown in FIG. 8, the height h1 can range from 1½ inches to 2¼ inches. Where the recess portion extends throughout the topwall 44, the height h2 will typically be 2¼ to 2¾ inches in height to accomodate the fitting 50, the drum insert 54, and the closure 60. The buttress thread length 11 in the neck portion 68 of the first fitting 50 is approximately ½ to ¾ of an inch. The length 12 of the threads on the second fitting 86 is approximately ½ inch. The height h4 of the first fitting 68, the portion of the drum insert above the fitting 68, and the closure 60, assembled together, is approximately 2¼ to 2¾ inches. The height h3 of the combined portion 119 of the drum insert and closure above the fitting 68, is approximately 1¼ inches for typical components.

The distance d1 is approximately half or less than half of the distance h2 from the recessed portion to the top 64 of the chime. The height h3 is also approximately half or less than half of the distance h2 from recessed portion to the top 64 of the chime. And significantly, the height h4, which is the sum of d1 and h3, is less than the height h2.

The entire top structure 30 of the drum 24 is integrally formed by way of blow molding. An example of methodology for forming integral chimes during blow molding is disclosed in the prior art; for example, U.S. Pat. No. 4,228,122 to Theo Hammes and assigned to Mauser-Kommandit Gesellschaft, which is hereby incorporated by reference.

Figure 10:
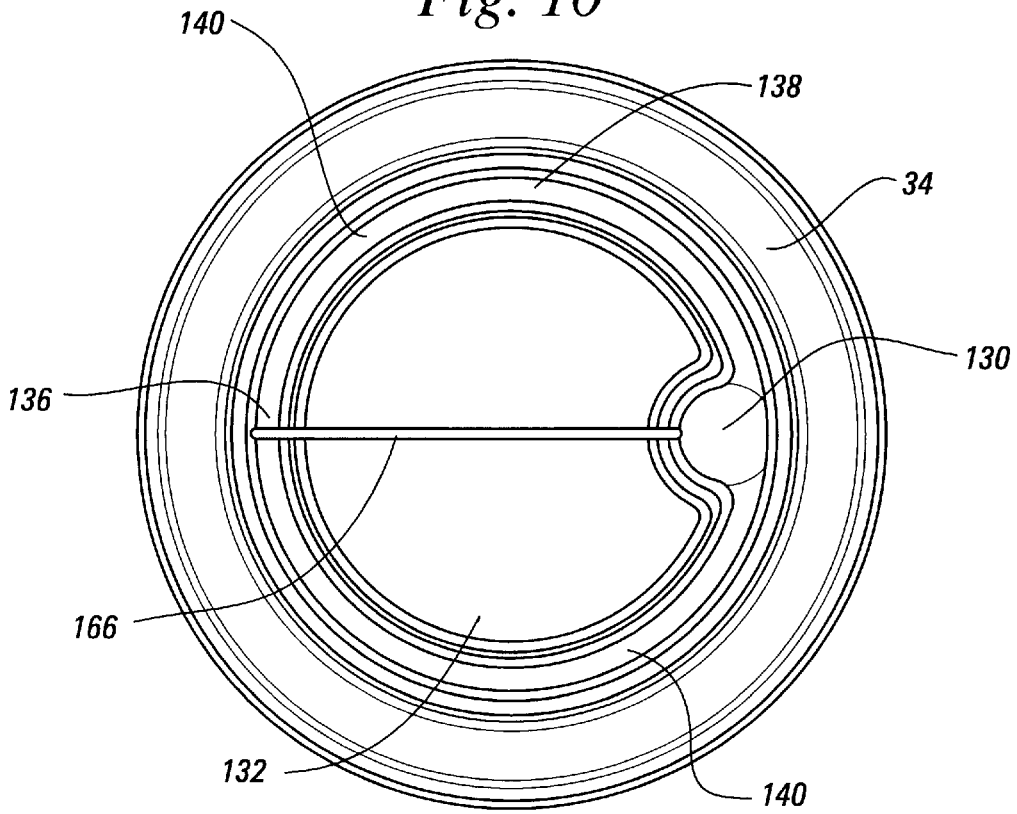
FIGS. 10 and 11 are detail views of the bottom structure of the drum according to the invention.
Figure 11:
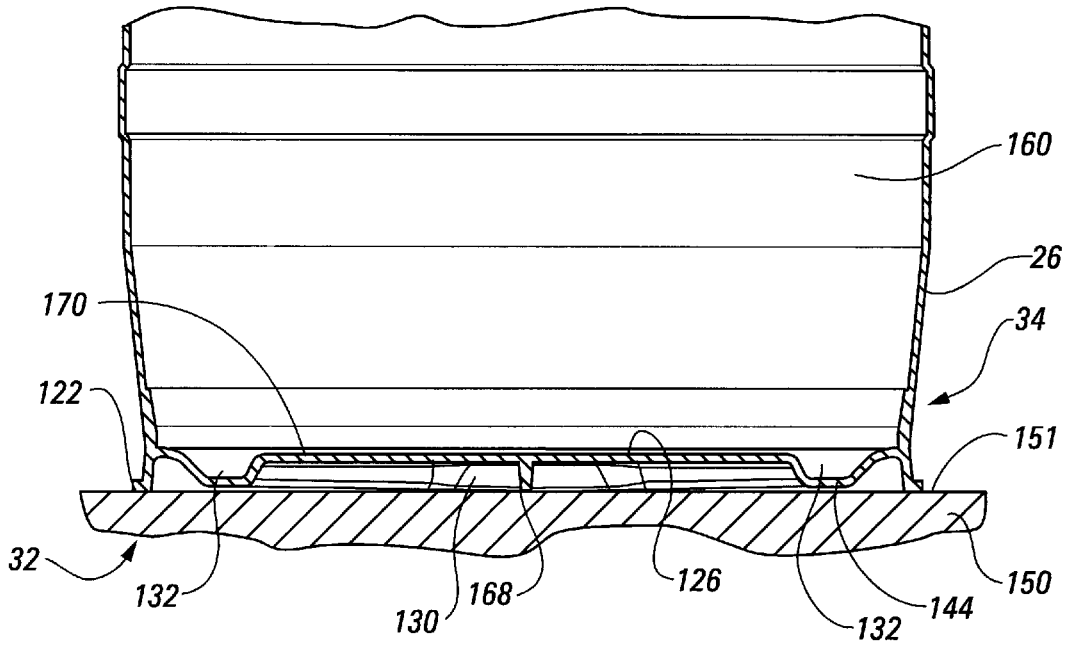

Referring to FIGS. 7, 10, and 11, details of the bottom structure 34 of the drum are shown. A lower chime 122 extends downwardly from and is an integral part of the cylindrical side wall 26. Also integral is a bottom wall 126 which includes a sump 130 and a channel 132 including a raised channel portion 136 and inclined channel portions 138 and 140 which slope downwardly from the raised portion 136 to the sump 130. The raised portion 136 and the inclined portions 138, 140 may have the outside surface 144 of said features positioned to be slightly raised from a horizontal surface on which the drum may sit when the drum is empty or partially empty. Said spacing and thickness of the lower bottom wall may be configured such that as the barrel approaches a predetermined fill point, said channels are deflected downwardly by the weight of the liquid to contact and sit on the horizontal surface 150 defining a resting plane 151. Then as the barrel is emptied, said features can be raised off of the horizontal surface to allow complete drainage of the channel. Such a resilient raised portion allows maximum capacity of the drum while still facilitating stability and total drainage of the interior 160 of the drum.

During the blow molding process, the parisan is pinched off as is disclosed in U.S. Pat. No. 4,946,368 to Masumoto and assigned to Mitsui Petro-Chemical Industries, Ltd. Said patent is hereby incorporated by reference. The pinched off parisan 166 is pinched off at the lower surface 168 rather than at a location adjacent to the bottom wall. This additional member 166 can provide additional stability for the drum when placed on a horizontal surface and can further facilitate the drainage function by maintaining and controlling the height of the midportion 170 of the bottom wall, particularly with respect to the channels 132. Additionally the member 166 can facilitate movement of the barrel when in the upright position on roller conveyors.

As with the top structure, all of the components and features as shown in FIGS. 7, 10 and 11 are integrally formed during the blow molding process.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

We claim:

1. A combination plastic molded drum, drum insert, and closure, the plastic molded drum comprising a cylindrical wall, a top structure, and a bottom structure: the top structure, the cylindrical wall, and the bottom structure all integrally molded;

the top structure comprising a top wall and a chime having a top edge extending circumferentially around, upwardly, and radially outward with respect to said top wall, the top wall comprising an integrally molded recessed portion, the top structure further comprising an upwardly extending first fitting integrally molded with the recessed portion, the first fitting having a first neck portion with a threaded portion and a first shoulder, the drum insert comprising a base portion, an integral second fitting portion, and a downhole tube portion, the base portion sized for threadably engaging the first neck portion, the second fitting comprising a second threaded neck portion and a shoulder portion, the second fitting positioned above the base portion such that when the drum insert is assembled with the first fitting the second fitting is above the first fitting, the closure comprising a plug portion and a handle, the plug portion sized to sealingly plug into the second fitting, handle extending circumferentially around the plug portion and rotatably secured thereto, the handle threadably engageable with the second fitting to secure the closure in place on the drum insert, the recessed portion positioned such that the first fitting, the drum insert, and the closure do not extend above the top edge of the chime.

2. The combination of claim 1 wherein the recessed portion is localized around the first fitting.

3. The combination of claim 1 wherein the recessed portion extends substantially throughout the top wall.

4. The combination of claim 1 wherein the closure comprises a vent outlet and a vent valve for relieving pressure within the drum.

5. The combination of claim 4 further comprising a cover extending over the handle, the vent outlet, and vent valve.

6. A combination blow molded plastic drum, drum insert, and closure, the plastic molded drum comprising, a cylindrical wall, a top structure, and a bottom structure, the top structure and the cylindrical wall integrally molded;

the top structure comprising a top wall, an integral recessed portion, an upwardly extending first fitting, and an upwardly extending chime; the top wall, the recessed portion, the first fitting, and the chime all integrally molded;

the drum insert comprising a base portion threadably engaging the first neck portion, and a second fitting extending upwardly from the base portion, the second fitting having threads positioned above the first fitting, and a downtube portion extending downwardly from the base portion;

the closure comprising a plug portion and a nut portion, the plug portion sized to plug the second fitting, the nut portion extending around the plug portion and threadably engageable with the second fitting to secure the closure in place on the drum insert; and the chime extending above the closure when the closure is secured on the drum insert.

7. The combination of claim 6, wherein the first fitting has internal threads and the base portion has cooperating external threads.

8. The combination of claim 6, wherein the recessed portion is localized around the first fitting.

9. The combination of claim 6, wherein the recessed portion extends substantially throughout the top wall.

10. The combination of claim 6, wherein the closure comprises a vent outlet and a vent valve for relieving pressure within the drum.

11. The combination of claim 6, wherein the first fitting extends from the recessed portion a distance not more than substantially one half the vertical distance between the recessed portion and the top edge of the upperwardly extending chime.

12. A plastic molded drum comprising, a cylindrical wall, a top wall, a bottom wall, and an upwardly extending chime extending from the top wall, all of which are integrally molded, the drum further comprising a first fitting extending upwardly from the top wall, a drum insert threadably attached to the first fitting, having a second fitting extending upwardly from the first fitting and a downhole tube portion extending downwardly from the base portion, the drum further comprising a closure having a plug portion and a nut portion, the plug portion engageable into the second fitting, the nut portion threadably engageable with the first fitting, the closure extending upwardly from the second fitting, the chime and top wall configured such that the closure does not extend above the chime.

13. The combination of claim 12, wherein the first fitting has internal threads and the base portion has cooperating external threads.

14. The combination of claim 12, wherein the closure comprises a vent outlet and a vent valve for relieving pressure within the drum.

15. The combination of claim 12, wherein the first fitting extends from the top wall a distance not more than substantially one half the vertical distance between the top wall the uppermost portion of the chime.

16. A blow molded plastic drum formed from a parison, the drum comprising a cylindrical wall, a top structure, and a bottom structure, the bottom structure and the cylindrical wall integrally molded;

the bottom structure comprising a downwardly extending chime with the lower surface defining a resting plane for seating on a horizontal surface, a bottom wall portion, the bottom wall portion having formed therein a sump, a centrally positioned upwardly relieved area, a channel extending in a generally circular direction around the centrally positioned upwardly relieved area and an elongated web member traversing below the upwardly relieved area and extending downwardly substantially to the level of the resting plane, said member providing support for the upwardly relieved area and formed from the parison pinched off during the blow mold process.

17. The drum of claim 16 wherein the channel is inclined toward the sump.

18. The drum of claim 16 wherein the bottom wall at the channel is raised from the resting plane.

* * * * *